US006453880B1

(12) United States Patent
Nicol et al.

(10) Patent No.: US 6,453,880 B1
(45) Date of Patent: Sep. 24, 2002

(54) FUEL INJECTION PUMP

(75) Inventors: Stuart-William Nicol; Stephan Jonas, both of Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/582,619

(22) PCT Filed: Oct. 13, 1999

(86) PCT No.: PCT/DE99/03282

§ 371 (c)(1),
(2), (4) Date: Aug. 25, 2000

(87) PCT Pub. No.: WO00/26520

PCT Pub. Date: May 11, 2000

(30) Foreign Application Priority Data

Oct. 29, 1998 (DE) ..... 198 49 925

(51) Int. Cl.[7] ..... F02M 37/04
(52) U.S. Cl. ..... 123/502; 123/179.17
(58) Field of Search ..... 123/502, 179.17, 123/500, 501, 449

(56) References Cited

U.S. PATENT DOCUMENTS 4,037,573 A * 7/1977 Swift ..... 123/500
4,329,961 A * 5/1982 Johnston ..... 123/502
4,384,562 A * 5/1983 Hammock ..... 123/502
4,408,591 A * 10/1983 Nakamura ..... 123/502
4,422,428 A * 12/1983 Eheim ..... 123/502
4,610,234 A * 9/1986 Sakuranaka ..... 123/502
5,125,802 A * 6/1992 Nakamura et al. ..... 417/221
5,647,327 A * 7/1997 Enomoto et al. ..... 123/502
5,769,056 A * 6/1998 Geiger et al. ..... 123/502
6,041,760 A * 3/2000 Fehlmann et al. ..... 123/502
6,116,220 A * 9/2000 Geiger et al. ..... 123/502

* cited by examiner

*Primary Examiner*—Carl S. Miller
(74) *Attorney, Agent, or Firm*—Ronald E. Greigg

(57) ABSTRACT

A fuel injection pump has an injection adjuster whose injection adjuster piston is acted upon on one face end by a restoring spring and by a pressure controlled by a control slide. On another face end the injection adjuster piston is exposed constantly to a pressure fluid source, which furnishes an rpm-dependent pressure. The control slide is adjusted positively by a control piston actuated by a control pressure, and in the process the control piston varies the pressure, acting the one face end, in a closed first pressure chamber. The injection adjuster piston is thus free of relatively high adjusting pressures acting on the injection adjuster piston transversely to a direction of motion.

22 Claims, 3 Drawing Sheets

FUEL INJECTION PUMP

PRIOR ART

The invention is based on a fuel injection pump as a set forth hereinafter. In one such fuel injection pump, known from German Patent Disclosure DE 44 40 749, the injection adjuster piston with one face end encloses the first pressure chamber in the cylinder and with its other face end encloses a spring chamber, which is pressure-relieved, in the cylinder. The control slide is provided in the injection adjuster piston and is actuatable by a control piston. With one end, this control piston protrudes into the second pressure chamber that receives the compression a spring, and the control piston acts upon the control slide counter to the force of a restoring spring that engages the control slide. On the other end, in a part structurally connected to the housing and separate from the second pressure chamber, the control piston is acted upon by a control pressure that adjusts the control piston counter to a restoring spring, whereupon the control slide follows along with the adjustment of the control piston under the influence of the restoring spring.

For adjusting the injection adjuster piston, the first pressure chamber is acted upon by a pressure fluid that is controlled by the adjustment of the control slide relative to the control piston and that is supplied to the control slide via a radial bore in the injection adjuster piston. To that end, there is also a pressure fluid inlet in the circumferential wall of the cylinder, and this pressure fluid inlet communicates constantly with a groove extending in the adjusting direction of the control piston, from which the radial bore leads to the cylinder bore that receives the control slide. The injection adjuster piston is thus acted upon by forces because of the unilateral inlet of the pressure fluid. Furthermore, through a recess in the cylinder wall, there is a communication with a pump interior in which the cam drive is located. This cam drive, with an actuating arm, reaches through this recess into a corresponding indentation of the injection adjuster piston, so that the injection adjuster piston, in the course of its longitudinal motion, can effect a rotation of the cam drive. From this side, a unilateral pressure relief of the injection adjuster piston is accomplished. In this known pump, complicated means must be provided with which the unilateral stresses on the injection adjuster piston are compensated for, to prevent disruptions in operation caused by wear. In particular, if the injection adjuster piston is connected eccentrically to the associated cam drive, forces additionally enter from the side of the cam drive and act in the form of tilting moments on the injection adjuster piston, consequently leading to increased unilateral, local pressures between the jacket face of the injection adjuster piston and the cylinder guide receiving it.

ADVANTAGES OF THE INVENTION

According to the fuel injection pump of the invention, it is attained that the injection adjuster piston is acted upon by high adjusting pressure only in the axial direction and is not exposed to any radially acting force components that would entail the aforementioned risk. The force exerted on the injection adjuster piston by the second pressure chamber serves as a constant base stress, which counteracts the restoring force in the first pressure chamber. The restoring forces of the restoring means in the first pressure chamber also act exclusively axially on the injection adjuster piston. Furthermore, the chamber receiving the cam drive is embodied as a relief chamber, so that in operation of the mechanical connection of the cam drive, which connection is realized in the form of an actuating arm, to the adjusting piston, once again there is no high pressure acting radially on the injection adjuster piston. The injection adjuster piston is thus loaded evenly by its adjusting means. Accordingly, the frictional forces and thus the wear between the injection adjuster piston and its cylinder wall receiving the adjuster piston are reduced.

Advantageous refinements of the invention are shown with their advantages in conjunction with the ensuing description of an exemplary embodiment.

A BRIEF DESCRIPTION OF THE INVENTION

Three exemplary embodiments of the invention are shown in the drawings and will be described in further detail below.

Figure 1:
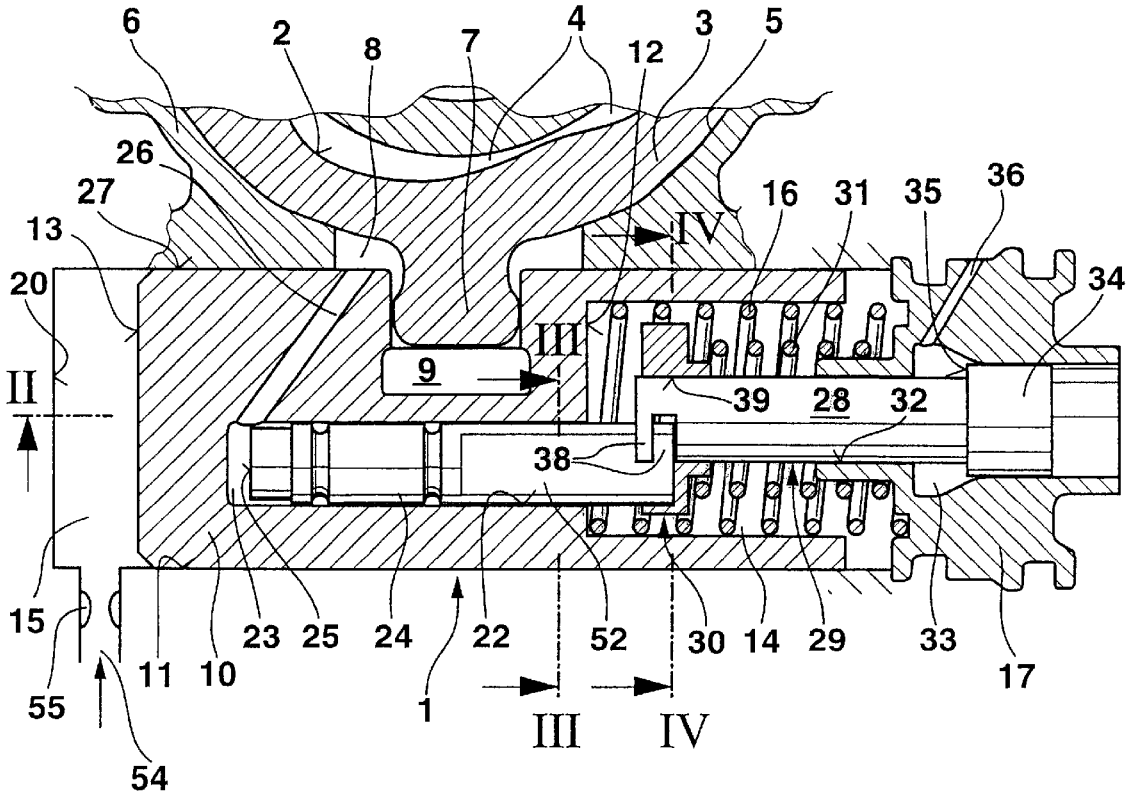
FIG. 1 shows a first exemplary embodiment of the invention in a sectional view through the injection adjuster of a fuel injection pump of the radial piston type, of which only the cam ring of the cam drive of the pump pistons of the fuel injection pump is shown.
Figure 3:
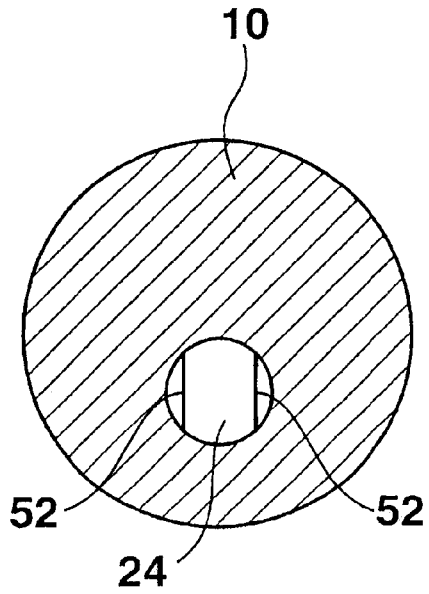
Figure 4:
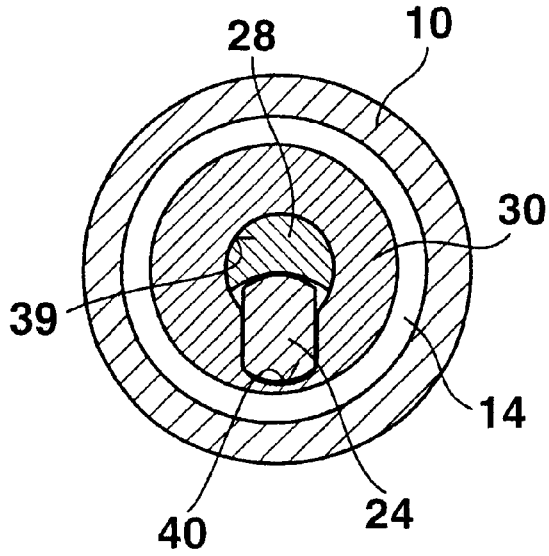
Figure 5:
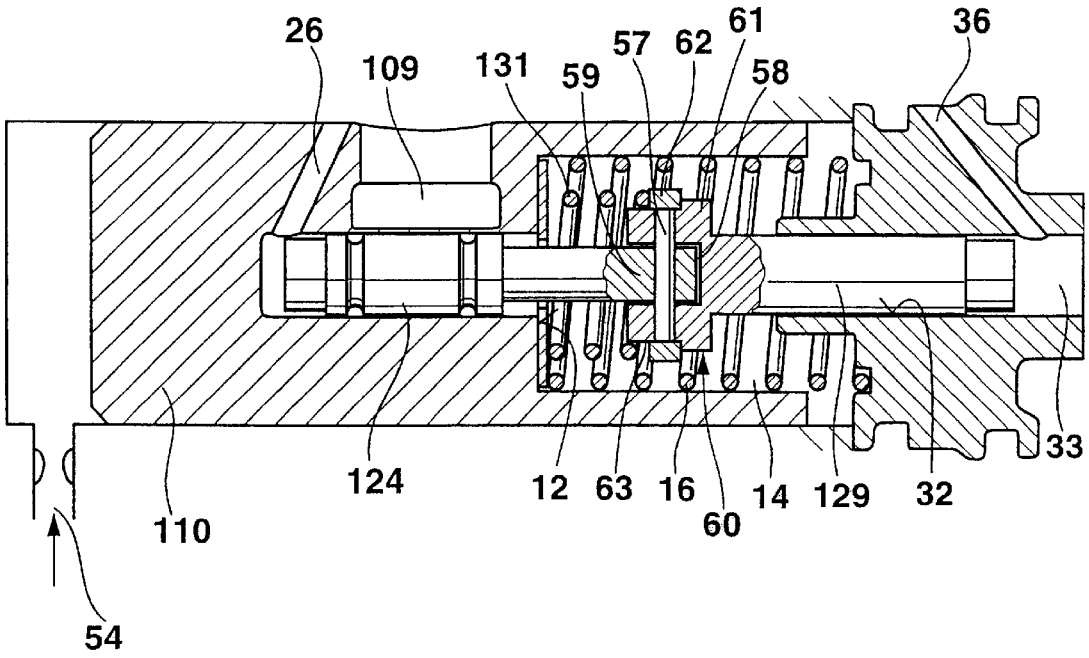
Figure 6:
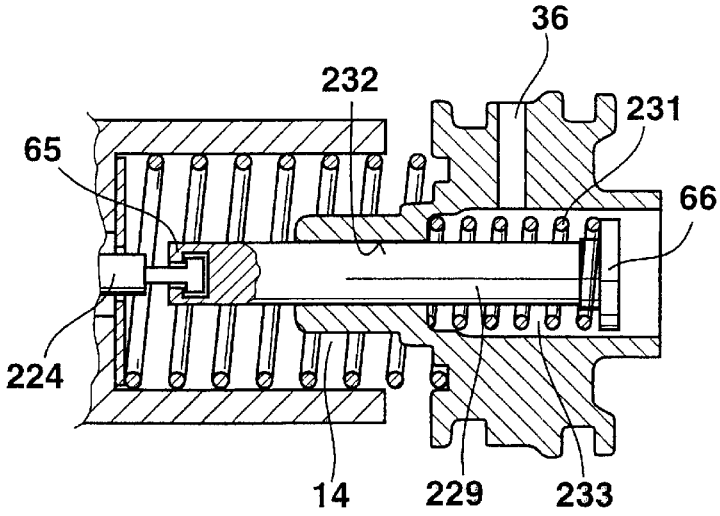

FIG. 3 is a section through the injection adjuster piston taken along the line in FIG. 1, FIG. 4 is a section taken through the injection adjuster piston along the line IV—IV; in FIG. 5 shows a second exemplary embodiment of the invention with an alternative coupling of the control slide to the control piston; and FIG. 6 shows a third embodiment of the invention with a modified control piston and a modified coupling of the control piston to the control slide.

DETAILED DESCRIPTION

Fuel injection pumps of the distributor type can be provided either with an axially driven pump piston, acting as both a distributor and a pump piston, or else radial pistons can be provided that feed radially into a feed conduit disposed in a distributor. In both cases, the pump pistons are driven by a cam drive that is moved by the drive shaft of the fuel injection pump. Part of one such so-called radial piston pump is shown in section in FIG. 1. In both pumps, by way of example four pump pistons, not shown here, are provided, which are supported in tightly displaceable fashion in radial bores of the distributor that extend at the same angular spacing from one another, radially to the axis of the distributor. On one face end, these bores enclose a common pump work chamber, which in the radially outward stroke of the pump pistons is filled with fuel in a known manner and in the radially inward stroke of the pump pistons communicates via a pressure line with a distributor opening on the jacket face of the distributor. The distributor opening triggers injection lines, originating at the circumference of the distributor, each of which is supplied in the inward motion of the pump pistons with fuel brought to injection pressure. The distributor is driven to rotate by a drive shaft, in such a way that on the one hand the distributor opening can perform its control function and on the other the pump pistons are moved in the circumferential direction along a cam path. This construction is not shown in detail here, because it is understood to be well known. All that is shown is a portion of the cam path 2, which is disposed on the inside of a cam ring 3; the pump pistons take this path. The cam ring 3 represents the essentially stationary part of the cam drive of the pump pistons, while the device that moves the pump pistons and that can for instance be a ring or distributor that guides the roller tappets of the pump pistons and is coupled to the drive shaft, represents the moving part of the cam drive. The cam ring is supported by its outer circumference in a cylindrical recess 5 in the housing 6 of the fuel injection pump and can be rotated in a plane perpendicular to the drive axis of the fuel injection pump. By the rotary position of the cam ring, the instant of the feeding stroke onset of each of the pump pistons can now be varied, relative to the drive motion of the distributor.

The injection adjuster piston is tightly displaceable in a cylinder 11 and with one face end 12 and the closed end of the cylinder 11, it encloses a first pressure chamber 14, and with its other face end 13 in the cylinder 11 that is also closed there, it encloses a second pressure chamber 15. A restoring spring 16 is disposed in the first pressure chamber; one end of this spring is braced on a closure part 17 that closes the cylinder 11, and its other end is braced on the first face end 12 of the injection adjuster piston 10 and thus fastened seeks to bring the injection adjuster piston, with its other face end 13, into contact with the wall 20 oppositely closing the cylinder 11, or with a stop disposed there. For the sake of rotation, the cam ring 3 has a coupling part in the form of an integral peg 7, protruding outward radially from the cam ring which plunges through an aperture 8 in the wall of the cylinder 11 from the interior 4, receiving the cam drive, of the fuel injection pump, on into an indentation 9 of an injection adjuster piston 10.

Also provided in the injection adjuster piston 10 is a cylinder bore 22, in the form of a blind bore that originates at the one face end 12 and is located eccentrically, axially to the axis of the injection adjuster piston. A control slide 24 inserted there, with one face end 25 and the end of the blind bore, encloses a third pressure chamber 23, which communicates constantly, via a conduit 26 that discharges at the jacket face 27 of the injection adjuster piston, with the aperture to the pressure-relieved interior 4 of the fuel injection pump. On the other end, the control slide protrudes into the first pressure chamber 14, where it is coupled with a tappet 28 of a control piston 29.

This tappet at this location has a spring plate 30, on which one end of a control spring 31 is braced that is braced on its other end on the closure part 17. The tappet is guided in a bore 32 of the closure part 17 that is coaxial with the axis of the injection adjuster piston, and the tappet protrudes in a chamber in the form of a cylinder 33 that is disposed inside the closure part 17. There, the tappet changes over into a piston 34, which slides tightly in the cylinder and toward the side of the first pressure chamber 14 together with the tappet 28 encloses a work chamber 35, which is supplied with pressure fluid via a bore 36. The other side of the piston 34 is exposed to the pressure of a relief chamber. The pressure fluid supplied to the work chamber 35 is kept at a control pressure, which is substantially rpm-dependent but can also be varied as a function of other engine parameters, such as the load. The thus-varied outlet pressure is furnished in a known manner in a control pressure source, not further shown here. If the pressure rises in the work chamber 35, the tappet 28 is displaced together with the piston 34 counter to the force of the control spring 31. To enable the control slide 24 to follow along with the motion of the control piston 29 even without coupling by nonpositive engagement, which is conventially achieved by a weak spring, the control slide 24 here is coupled to the tappet 28 of the control piston 29 by a positive connection. For this purpose, none claw 38 each is provided on adjacent ends of the control slide and of the tappet, the claws being congruent with one another, in such a way that the claws can be made to mesh with one another transversely to the motion of the control slide and of the tappet and are coupled substantially without play to one another in the adjusting direction. The coupled state can advantageously be secured by providing that the spring plate 30 is provided with a bore 39 both guiding the end of the tappet 28 and with a recess 40 surrounding the end of the control slide that is offset from the control piston; under the influence of the fastened control spring 31, the spring plate is retained in the position in which it surrounds the end of the control slide, and in addition the terminal position of the spring plate on the tappet is secured by contact with the end of the control slide. This installed situation is shown in FIG. 4 by a sectional view taken along the line IV—IV.

Figure 2:
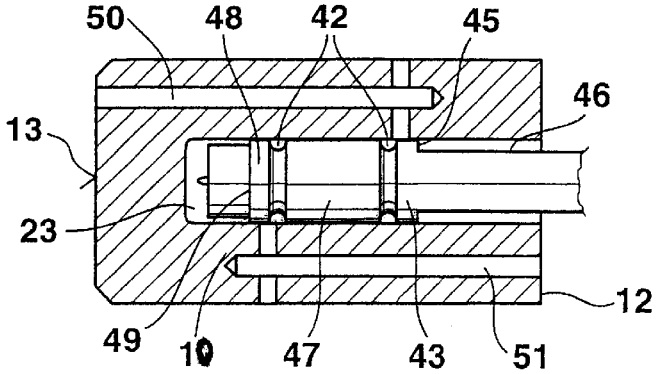
FIG. 2 is a fragmentary section along lines II—II through the injection adjuster piston of FIG. 1 in a plane perpendicular to the view of FIG. 1.

The control spring 31 disposed coaxially with the restoring spring 16 in the first pressure chamber 14 is bathed by pressure fluid, preferably pressure fluid furnished by the fuel, whose pressure is adjusted by the control slide. To that end, the control slide 24 has three annular collars, separated by two grooves 42, see FIG. 2; of them, a first annular collar 43 is disposed on the side toward the first pressure chamber 14 and has a first control edge 45, which is adjoined by a part of the control slide that is provided with a flow cross section 46 and that extends as far as the inside of the first pressure chamber 14. The flow passage is embodied in the form of a flattened face 52, as can also be seen in the section in FIG. 3, but it can also take any other shape. The middle annular collar 47 between the first annular collar 43 and the second annular collar 48 serves the purpose of hydraulic separation and guidance and does not itself have any control function. The second annular collar 48 has a second control edge 49 on the side toward the third pressure chamber 23.

In the injection adjuster piston, an inflow bore 50, originating at the other end face 13 and leading away from the second pressure chamber 15, and an outflow bore 41, extending from the first face end 12 of the injection adjuster piston and into the first pressure chamber, are also provided, which extend parallel to the control slide and discharge, each via a short radial bore, into the cylinder bore 22 of the control slide. The orifices of the inflow bore and outflow bore are spaced apart axially by a distance that is less than the axial spacing of the two control edges 49 and 45 from one another, so that in a middle position of the control slide 24, both bores are closed. As can be seen from FIG. 2, depending on the location of the control slide relative to the injection adjuster piston, the inflow or the outflow bore is then opened, so that the first pressure chamber communicates with the pressure source of the second pressure chamber or is relieved toward the relief chamber 4. Correspondingly, the pressure in the first pressure chamber is controlled, and if one parameter changes, the injection adjuster piston with the additional influence of the restoring spring is adjusted by the pressure in the second pressure chamber, until a communication with the first or second pressure chamber is reestablished by the respective control edge. The control slide then closes both bores, that is, the inflow bore 50 and the outflow bore 51, and the injection adjuster piston stays in the position it has now attained. If the control slide is then adjusted as a function of varying operating parameters of control pistons, this can be done toward either the right or the left. Depending on this, the pressure in the first pressure chamber is relieved via the outflow bore 51 and the conduit 26, or this pressure is raised via the pressure fluid flowing in via the inflow bore, with an ensuing adjustment of the injection adjuster piston until there is an equilibrium of forces.

The control slide 24 and the control piston 29 are in a state of force equilibrium with respect to the pressure imposed in the first pressure chamber 14, since in the region of the first pressure chamber they both have the same diameter. The control pressure fed into the work chamber 33 can be derived from the pressure prevailing in the second pressure chamber; for example, the work chamber 33 communicates via a throttle with the inlet to the second pressure chamber and can be relieved toward the relief chamber via a variable outflow throttle. Instead of the variable throttle, a magnet valve can also be used, which is clocked or adjusted analogously accordingly. This is then done as a function of operating parameters that have not yet affected the pressure of the pressure fluid inlet to the second pressure chamber 15. The pressure in this pressure chamber is generated by the feed pump and is thus rpm-dependent. The back side of the piston 34 of the control piston is pressure-relieved, so that in a leakage of pressure fluid can flow away there. As the pressure fluid, fuel is used, but a separate pressurized oil loop can also be employed. To counteract pressure fluctuations, a throttle 55 is also disposed in an inlet line, which as a function of rpm supplies the pressure fluid, pressurized oil, from the feed pump of the fuel injection pump to the second pressure chamber 15; this throttle prevents the second pressure chamber 15 upon a sudden stress by the cam ring in the feed phase of the pump pistons from being overly yielding.

A second exemplary embodiment of the invention is shown in FIG. 5. This exemplary embodiment differs from the first exemplary embodiment in that the control slide 124 is now disposed coaxially with the injection adjuster piston 10; the indentation 109 is not as deep as the indentation 9 in the exemplary embodiment of FIG. 2. Accordingly, the control slide 124 is now coaxial with the control piston 129, and so the connection between the control slide 124 and the control piston 129 can now be achieved simply by means of a pin 57. To that end, the end of the control piston 129 located in the first pressure chamber 14 is embodied as cup-shaped, with a recess 58 into which the end 59 of the control slide 124 plunges. By means of the cup-shaped end 60 of the control piston 129, the pin 57 is guided through corresponding bores transversely to the axes of the control slide 124 and the axis of the control piston 129. On its outer circumference, the cup-shaped part 60 has a collar 61, onto which a ring 62 is slipped or pressed that is in coincidence with the ends of the transverse pin 57. The pin is thus secured against shifting. The ring additionally serves as a support for the control spring 131, which is now braced on the face end 12 of the injection adjuster piston 110 and is capable of keeping the ring 62 in its position. However, it is also possible for the ring 62 to be pressed onto the cup-shaped part 60. The outer jacket face 63 of the cup-shaped part, which then protrudes from the ring 62, serves to guide the control spring 131 radially.

In a departure from the version of FIG. 1, the control piston 129 no longer has any tappet that is recessed in a special way. The bore 32 receiving the control piston is embodied as a cylinder 33, in that one end of the control piston 129 plunges into the bore 32. The other end of the control piston 129, plunging into the first pressure chamber 14, then serves the purpose of coupling to the control slide 124. The rearward region of the control piston that communicates with the relief chamber as provided in FIG. 1 is thus omitted.

As in the exemplary embodiment of FIG. 1, the control slide 124 and the control piston 129 have the same area exposed to the pressure in the first pressure chamber 14. However, the working direction of the control piston 129 is now reversed.

In FIG. 6, a third variant is provided, in a modification of the version of FIG. 5. Once again, the control slide 224 and control piston 229 are disposed axially to one another. The coupling of these two parts to one another is made by a dovetail connection of a type known per se. In a departure from FIG. 5, the control spring 31 is now shifted out of the first pressure chamber 14 into the cylinder 233. The cylinder 33 is increased relative to the diameter of the bore 32, so that the cylinder can receive the control spring 231, together with a headlike end 66 on which the control spring 231 is braced on one of its ends. The other end is braced on the housing at the transition from the bore 232 to the cylinder 233. The cylinder 233 here is again acted upon in the same way as in the exemplary embodiment of FIG. 5 with control pressure, which displaces the control piston 229 toward the control slide 224, counter to the force of the control spring 231.

With the version furnished here, an injection adjuster of a fuel injection pump is attained whose injection adjuster piston is no longer loaded by relatively high pressures unilaterally and transversely to the adjusting direction. Because of the control slide disposed offset from the axis of the injection adjuster piston, the peg 7 can engage far into the inside of the injection adjuster piston 10, which lessens the generation of tilting moments on the injection adjuster piston.

The foregoing relates to a preferred exemplary embodiment of the invention, it being understood that other variants and embodiments thereof are possible within the spirit and scope of the invention, the latter being defined by the appended claims.

We claim:

1. A fuel injection pump, comprising a housing, a cam drive for at least first and second pump pistons and an injection adjuster piston (10), serving to adjust an injection onset and acting on the cam drive, said adjuster piston, with one face end (12), defines a first pressure chamber (14) in a cylinder (11) and with another face end (13) defines a second pressure chamber (15) in the cylinder (11), the second pressure chamber is acted upon by a pressure fluid which adjusts the injection adjuster piston (10) counter to a restoring means disposed in the first pressure chamber (14), a a control slide (24), which is disposed displaceably in a cylinder bore (22) so as to be movable counter to a force of control spring (31) into one of three ranges of positions. the control slide (24), having control edges (45, 49) so that in one of the three ranges of positions the control slide opens a pressure fluid inlet (50) to one of the pressure chambers (14) in a second of three ranges of positions the control opens a pressure fluid outlet (51) from one of the pressure chambers (14), and in the third of the three ranges of positions the control slide closes both pressure fluid inlet (50) and pressure fluid outlet (51), the second pressure chamber (15) communicates with fluid from a from a pressure source, and the first pressure chamber (14) is made to communicate only with either the pressure fluid inlet (50) that is controlled by the control slide (24) or with the pressure fluid outlet (51) that connects the first pressure chamber (14) to a relief camber.

2. The fuel injection pump of claim 1, in which as the restoring means, in addition to the pressure controlled by the control slide (24), a restoring spring (16) is provided.

3. The fuel injection pump of claim 1, in which the control pressure is adjusted as a function of the rpm and additionally by other operating parameters of the engine.

4. The fuel injection pump of claim 2, in which the control pressure is adjusted as a function of the rpm and additionally other operating parameters of the engine.

5. The fuel injection pump of claim 3, in which the second pressure chamber (15) communicates constantly with a pressure side of a feed pump serving to supply low-pressure fuel to the fuel injection pump.

6. The fuel injection pump of claim 5, in which the feed pressure of the feed pump varies as a function of the driving rpm of the fuel pump.

7. The fuel injection pump of claim, 5, in which a throttle (55) is disposed in the connection between the second pressure chamber (15) and the fuel pump.

8. The fuel injection pump of claim 1, in which the injection adjuster piston (10) has a recess (9) on its jacket face which serves to receive a control arm (7) and which communicates with the interior (4) of the fuel injection pump.

9. The fuel injection pump of claim 1, in which in the injection adjuster piston (10), in the axial direction of a cylinder bore (22) originating at the first face end (12) adjoining the first pressure chamber (14), in which bore the control slide (24) is displaceable and there, with the control edges (45, 49), depending on the position of the control slide (24) relative to the injection adjuster piston (10), controls the pressure fluid inlet (50) to one of the pressure chambers (14, 15) or the pressure fluid outlet (51) from one of the pressure chambers (14, 15) or closes both of them, the control slide (24) being actuatable by a control piston (29) which has an area that is acted upon by a control pressure counter to the pressure of a control spring (31) and is disposed into a chamber (35) disposed, separate from the cylinder (11), in a part (17) structurally connected to the housing, and the control slide (24), with one face end (25), encloses a third pressure chamber (23) in the cylinder bore (22), the third pressure chamber communicates constantly with the relief chamber, formed by a pump interior (4) of the fuel injection pump that receives the cam drive (3) of the fuel injection pump.

10. The fuel injection pump of claim 9, in which the control piston (28, 129, 229) communicates with the control slide (24, 124, 224) at least by positive engagement in the adjusting direction and has a face exposed to the pressure in the first pressure chamber (14) in the adjusting direction, the face is the same size as the area of the control slide (24, 124, 224) exposed to the pressure in the first pressure chamber (14) in the adjusting direction.

11. The fuel injection pump of claim 9, in which the control slide (24, 124, 224) has a piston part with a first control edge (45) that controls the pressure fluid inlet (50) to the first pressure chamber (14), and a second control edge (49) that controls the pressure fluid outlet (51) from the first pressure chamber (14), the first and second control edges are adjoined by flow cross sections (52, 23) on the control slide that serve to carry pressure fluid, and the entrance of the pressure fluid inlet (50) into the cylinder bore (22) and the exit of the pressure fluid outlet (51) from the cylinder bore (22) are offset from one another in the axial direction of the control slide.

12. The fuel injection pump of claim 2, in which the control slide (24, 124, 224) has a piston part with a first control edge (45) that controls the pressure fluid inlet (50) to the first pressure chamber (14), and a second control edge (49) that controls the pressure fluid outlet (51) from the first pressure chamber (14), the first and second control edges are adjoined by flow cross sections (52, 23) on the control slide that serve to carry pressure fluid, and the entrance of the pressure fluid inlet (50) into the cylinder bore (22) and the exit of the pressure fluid outlet (51) from the cylinder bore (22) are offset from one another in the axial direction of the control slide.

13. The fuel injection pump of claim 11, in which a restoring spring adjusts the pressure fed into the first pressure chamber (14) by the control slide and a compression spring (16) serves to brace the piston in the first pressure chamber (14) between the injection adjuster piston (10) and the housing.

14. The fuel injection pump of claim 13, in which the control spring (31) of the control piston (29) is disposed in the first pressure chamber (14) and is fastened there between a spring plate (30), which is supported on a tappet (28) of the control piston (29), and a part (17) structurally connected to the housing.

15. The fuel injection pump of claim 13, in which the control spring (31) of the control piston (29) is disposed in the first pressure chamber (14) and is fastened between the control piston (29) and one face end (12) of the injection adjuster piston (10).

16. The fuel injection pump of claim 14, in which the control piston (29) plunges into the first control chamber, embodied as a control cylinder, disposed in the fixed housing part (17) and there, with a piston part, divides a control work chamber (35) from a relief chamber.

17. The fuel injection pump of claim 15, in which the control piston (29) plunges into the first control chamber, embodied as a control cylinder, disposed in the fixed housing part (17) and there, with a piston part, divides a control work chamber (35) from a relief chamber.

18. The fuel injection pump of claim 13, in which the control piston (229) plunges into the chamber (223) embodied in the part (17) structurally connected to the housing and is acted upon by the control spring (231), one end of the control spring (231) is braced on a shoulder (66) of the control piston (229) and another end of the control spring is braced on the part (17) structurally connected to the housing.

19. The fuel injection pump of claim 10, in which a positive connection between the control slide (24) and the control piston (29) comprises a claw connection, in which the control slide (24) is guided in a cylinder bore (22) that is offset from the axis of the injection adjuster piston (10).

20. The fuel injection pump of claim 10, in which a positive connection between the control slide (24, 124, 224) and the control piston (29, 129, 229) comprises a pin connection (57).

21. The fuel injection pump of claim 20, in which the pin connection (57) of the control piston comprises a cup-shaped end (60) on one of the ends, next to one another, of the control piston (129) or the control slide (124), plunges into an end of the control slide (124) or control piston (129), and is retained there via a transverse pin (57), said transverse pin (57) is guided by a wall of the cup-shaped end (60) and the end plunged into the cup-shaped end of the control slide (124), the transverse pin is fixed by a ring (62), which is slipped or pressed onto the cup-shaped end (60) and serves at the same time as a support of the control spring (131) which is otherwise guided on the remaining cup-shaped part.

22. The fuel injection pump of claim 21, in which the ring (62) is held in contact with an outer collar (61) of the cup-shaped end (60) under an influence of the control spring (131).

* * * * *